US005540344A

United States Patent [19]

Rosenthal et al.

[11] Patent Number: 5,540,344

[45] Date of Patent: Jul. 30, 1996

[54] ORIGINALITY-ENSURING DEVICE FOR CONTAINER CLOSURES

[75] Inventors: Karl-Heinz Rosenthal, Heichshof-Oberagger; Tom Kitzing, Wiehl-Weiershagen, both of Germany

[73] Assignee: AptarGroup S.A., Saint Germain en Laye, France

[21] Appl. No.: 246,726

[22] Filed: May 20, 1994

[30] Foreign Application Priority Data

May 24, 1993 [DE] Germany ..... 43 17 269.5

[51] Int. Cl.[6] ..... B65D 41/34; B65D 55/08

[52] U.S. Cl. ..... 215/250; 215/230; 215/252; 215/365; 215/901

[58] Field of Search ..... 215/250, 252, 215/227, 230, 365, 901

[56] References Cited

U.S. PATENT DOCUMENTS

| | | | |
|---|---|---|---|
| 1,908,245 | 5/1933 | Hogg | 215/252 |
| 3,812,991 | 5/1974 | Wurl | 215/252 |
| 4,530,437 | 7/1985 | Gray et al. | 215/252 |
| 4,596,339 | 6/1986 | Andersson | 215/252 |
| 4,610,367 | 9/1986 | Massott et al. | 215/252 |
| 4,679,696 | 7/1987 | Bonnenfant et al. | 215/252 |
| 4,690,291 | 9/1987 | Grant | 215/901 X |
| 4,700,859 | 10/1987 | Gregory | 215/252 |
| 4,775,064 | 10/1988 | Baxter | 215/230 |
| 5,135,123 | 8/1992 | Nairn et al. | 215/252 |
| 5,219,084 | 6/1993 | King | 215/252 |
| 5,400,913 | 3/1995 | Kelly | 215/252 |

FOREIGN PATENT DOCUMENTS

| | | |
|---|---|---|
| 37467/93 | 10/1993 | Australia . |
| 4207996A1 | 9/1993 | Germany . |

*Primary Examiner*—Sue A. Weaver

*Attorney, Agent, or Firm*—Dressler, Goldsmith, Shore & Milnamow, Ltd.

[57] ABSTRACT

An originality-ensuring device for container closures (32), having an indicator element (35) subdivided by predetermined breaking points (37) into individual segments (36), the indicator element (35) being formed as a separate part for self-holding arrangement in the container (23), at least partially embracing the latter, and the segments (36) being arranged with respect to one another in such a way that, when there is a relative movement of the segments or segment parts (40), owing to a clamping reception of the indicator element (35) between a container closure (32) and a container shoulder (21), there takes place a severing of the predetermined breaking points (37) for individual separation of the segments (36) and the latter are held in a clamping manner.

10 Claims, 3 Drawing Sheets

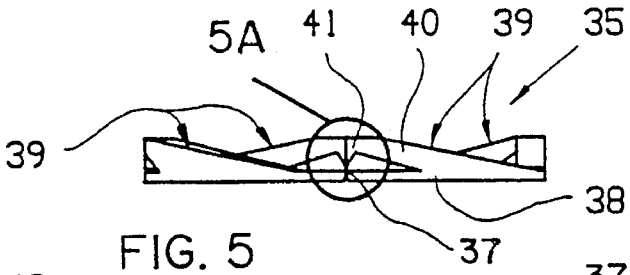
FIG. 5
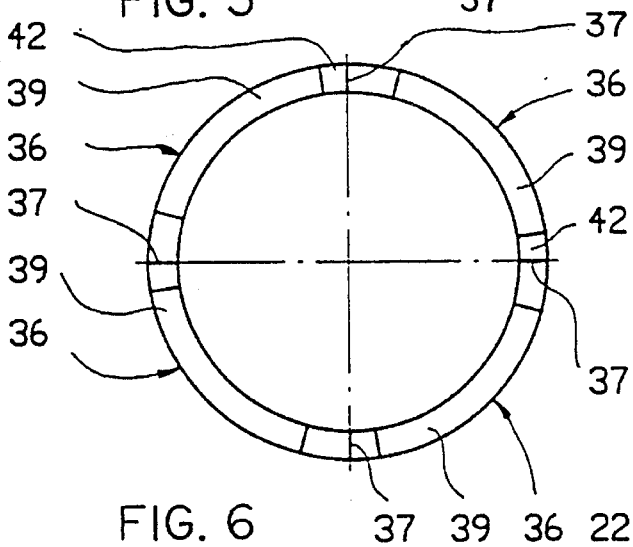
FIG. 6
FIG. 5A
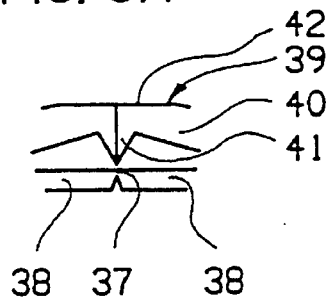
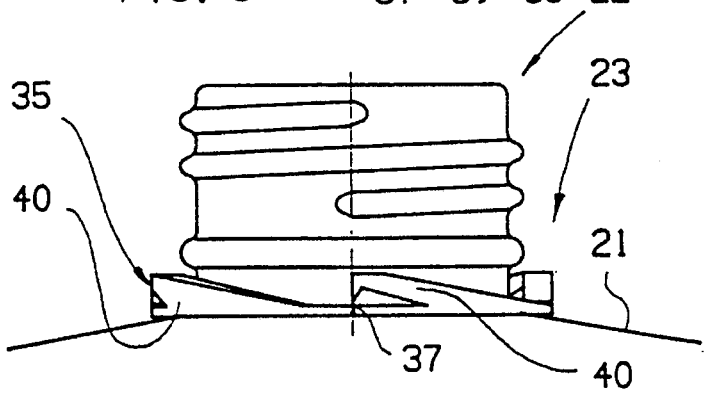
FIG. 7
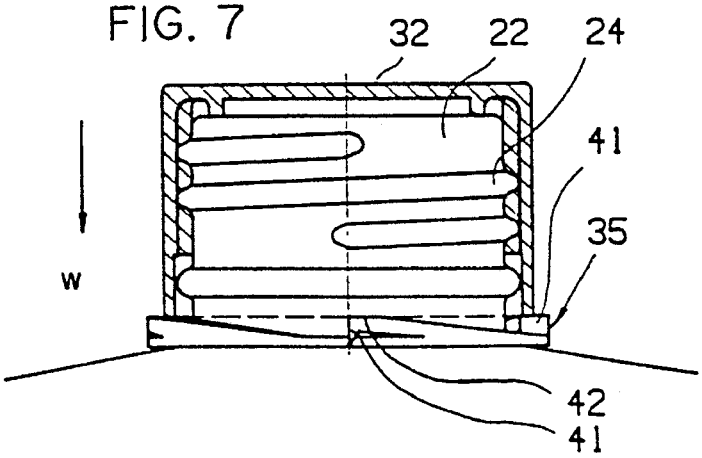
FIG. 8

ORIGINALITY-ENSURING DEVICE FOR CONTAINER CLOSURES

The present invention relates to an originality-ensuring device for container closures having an indicator element subdivided by predetermined breaking points into individual segments.

Such indicator elements have long been known and serve as means of checking, to be able to establish whether a container is in the originally closed state or whether it has already been opened. Such a possible means of checking can prove to be important both from the point of view of hygiene, for instance in the case of food, and from aspects of preservation, for instance in the case of drugs and cosmetics.

The previously known indicator elements are based on a common functional principle, which relies on the fact that in the closed state of the container a previous opening of the container is made identifiable by the segments of the indicator element being separated from one another at predetermined breaking points intended for this purpose. However, in this case the individual segments remain connected to a closure cap even after the separating operation. In the case of such a system, the means ensuring originality is connected directly to the closure, for example by being molded on, or else has been fitted into the closure in a prior operation. This has the result that the change which takes place to the originality-ensuring device as an indication of previous opening of the container is possible only on close inspection of the container closure. In particular in the case of originality-ensuring devices which, like a closure cap connected to them, consist of metal, for example aluminum, this has the effect of allowing the possibility of subsequent manipulations to the indicator element which make it virtually impossible to identify the separation of the segments at the predetermined breaking points under inspection of a rather casual nature; for example whenever the segments are bent back into their initial state by a bending action. This may give the outward impression that the predetermined breaking points are undamaged. All previously existing systems consequently rely on the fact that the means ensuring originality is not destroyed until the container is opened for the first time.

In contrast, the present invention is based on the object of improving an originality-ensuring device in such a way that the means ensuring originality is destroyed when the container is closed for the first time and an effective, visible protection against subsequent manipulations is accomplished.

This object is achieved by an originality-ensuring device having the features of claim 1.

In the case of the originality-ensuring device according to the invention, the indicator element is preferably a component which is separate from the container and its closure and requires no special fitting tools and no modification to tools for already existing container closure systems. The destruction of the predetermined breaking points connecting the individual, respectively neighboring segments of the indicator element consequently necessarily takes place when the container is closed for the first time after its filling with a product. Since the indicator element, as a separate part, is connected neither to the closure cap nor to the container, after the destruction of the predetermined breaking points the individual segments of the indicator element are held between the individual, neighboring segments between the closure cap and a supporting surface preferably formed by the container itself, generally a shoulder of the container.

This has the consequence that, when the container is opened for the first time, the clamping of the segments of the indicator element between the container closure and the container surface forming an abutment for the segments of the indicator element is released and the individual segments fall out of their clamping position between closure cap and container simply by the effect of gravity. Consequently, the difference between a container which is closed in the original state and a container on which the clamping effect has been discontinued by undoing the closure and at least some of the segments of the indicator element have been lost is clearly visible. Since, after opening for the first time, the indicator element is broken down into its individual component parts, a subsequent manipulation of the indicator element for the deceptive simulation of an originally closed state of the container, as described above, is no longer possible.

Although the indicator element according to the invention may have different forms, such as for example the form of an arc or a straight, short strip, a preferred embodiment of the originality-ensuring device according to the invention favors an indicator element which is of an annular design. This may be both a closed ring and a slit ring, which has the advantage over a closed design that the indicator element does not necessarily have to be fitted onto the container before fitting of the container closure, but may also be fitted onto the container from the side during closing of the container with the closure cap.

In the case of a preferred embodiment of the originality-ensuring device according to the invention, the segments of the indicator element are arranged on an imaginary conical surface and are interconnected by predetermined breaking points in the radially outer region of their circumferentially neighboring end faces. These predetermined breaking points secure the unloaded segments in their relative position with respect to one another and tear off when the individual segments are folded into another plane owing to an effect of pressure on them by the closure container. To prevent the predetermined breaking webs from slipping out of their position on the container after their tearing off, that is to say after individual separation of the segments, before achieving the clamping state of the segments, the individual segments may be provided radially on the inside with a detaining means.

In the case of a further embodiment of the originality-ensuring device according to the invention, the segments of the indicator element in each case have a separating means which is formed in one piece with said segments and serves for severing a predetermined breaking point respectively provided between two segments. This has the effect of ensuring that a severing at the predetermined breaking points only takes place when, due to the container closure, there is already a clamping effect securing the individual segments in their position on the container.

The separating means may be a flexible lever arm with a separating blade which is arranged at the free end and permits particularly easy severing of the predetermined breaking points. In addition, it also proves to be advantageous if the lever arm has opposite the separating blade an abutting surface which permits a reliable bearing contact of the container closure during closing and a guidance of the separating blade for reliable severing of the predetermined breaking point.

In the case of a further embodiment of the originality-ensuring device according to the invention, the segments of the indicator element comprise first and second segment legs arranged in a V-shaped manner in the circumferential direction of said element, the segment legs of two neighboring segments in each case being connected to each other by a predetermined breaking point. In the case of this embodiment also, the separating of the individual segments is accompanied by their clamping between the container closure and the container shoulder provided on the container, so that losing of the segments during the first closing operation is ruled out.

One segment leg of each segment may be provided at its upper end with an abutting nose, which protrudes beyond the adjacent segment leg of a neighboring segment in the region of the predetermined breaking point connecting them and is intended for bearing contact on the container closure during closing.

The first segment leg, provided with the abutting nose, preferably forms a more acute angle with the principal plane of the annular indicator element than the other, second segment leg of the same segment. This achieves the effect that, after the severing of the predetermined breaking point, the first segment leg, provided with the abutting nose, pushes underneath the second segment leg and the latter supports itself in a lever-like manner on the abutting nose of the first segment leg during further compressing of the indicator element owing to a continuing pressure of the container closure. As a result it is ensured that the individual segments are wedged against each other in the clamped-in state with a certain prestressing and are held particularly securely between the container closure and the container shoulder.

The preferred embodiments of the originality-ensuring device according to the invention are explained in more detail below with reference to the drawings, in which:

FIG. 5 shows a side view of a second embodiment of an originality-ensuring device in its undestroyed initial position, FIG. 5A being a detail noted in the circle 5A in FIG. 5, in enlarged representation;

FIG. 6 shows the originality-ensuring device according to FIG. 5 in plan view;

FIG. 7 shows a view of the annular originality-ensuring device according to FIG. 5, which lies around a container neck on a container shoulder;

FIG. 8 shows a view similar to FIG. 2 of the originality-ensuring device according to FIG. 7 in a securement position, clamped in between a container shoulder and a closure cap, partially in central longitudinal section;

Figure 1:
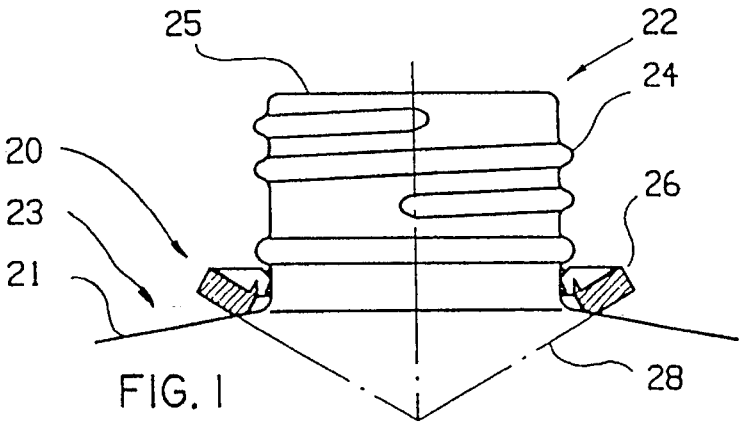
FIG. 1 shows a view of a first embodiment of an annular originality-ensuring device in its initial position placed around a container neck on a container shoulder, shown in central longitudinal section.

FIG. 1 shows a first embodiment of an originality-ensuring device which comprises an annular indicator element 20. The indicator element 20 rests on a supporting device, which is formed by a shoulder 21 of a container 23, from which shoulder there rises up a container neck 22, which is provided with an opening 25, has an external thread 24 and is surrounded by the indicator element 20. Although of course the direct resting or supporting of the annular indicator element 20 on the container itself is to be preferred, it could be necessary in some cases, depending on the form of the container, such as for example a very slender, high container neck, to provide a separately formed supporting device. Such a separate supporting device could be, for example, a separate ring which rests on studs projecting from a container neck and serves as an abutment for the indicator element.

Figure 3:
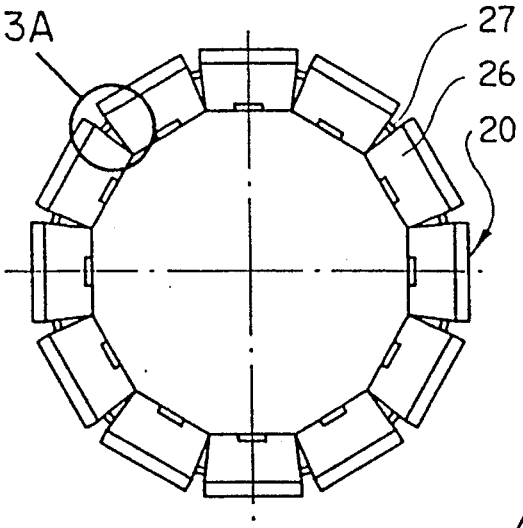
FIG. 3 shows a plan view of the undestroyed originality-ensuring device according to FIG. 1, FIG. 3A being a detail noted in the circle 3A in FIG. 3, in enlarged representation.
Figure 3A:
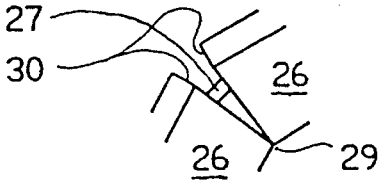

FIG. 3 reveals that the indicator element 20 is made up of individual, cuboidal or plate-shaped segments 26 and predetermined breaking points, which are formed as predetermined breaking webs 27. The surfaces formed by the underside of the individual segments 26 lie on an imaginary, conical enveloping surface 28, which is dot-dashed in FIG. 1 and the cone point of which is arranged on the bore S of the container opening 25.

It can be clearly seen from the detail Z in FIG. 3 that opposing end faces 30 of neighboring segments 26 form an outwardly opening angle and lie against each other at their inner edges 29. The end faces 30 are connected to each other in their outer region forming the angle or a gap, by the thin predetermined breaking webs 27.

Figure 2:
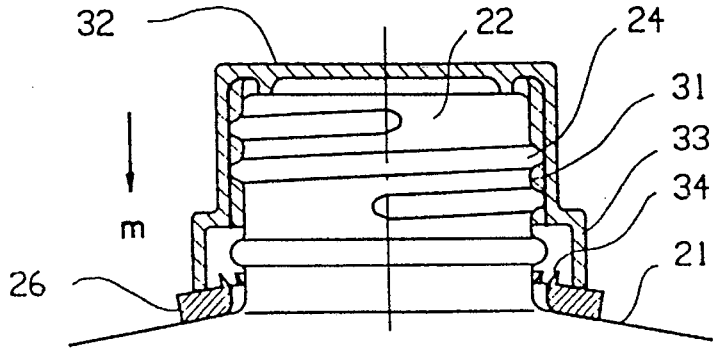
FIG. 2 shows a view of a vertical, central cross section of the originality-ensuring device according to FIG. 1 but in a flattened securement position, clamped in by a closure cap.

In FIG. 2 there is shown as the container closure a closure cap 32 having a cylindrical, lower, outwardly protruding cap skirt 33 and an internal thread 31, by which the closure cap 32 is screwed onto the external thread 24 of the container neck 22. In this case, the lower rim of the cap skirt 33 has pressed the segments 26 by its underside fully in the direction of the arrow m onto the container shoulder 21, so that the segments 26 are firmly clamped in between the closure cap 32 and the container shoulder 21.

Figure 4:
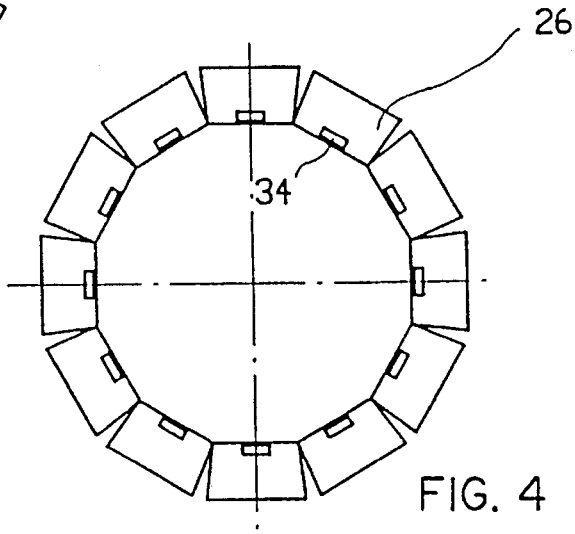
FIG. 4 shows a plan view of the originality-ensuring device represented in FIG. 2, segmented by clamping.

FIG. 4 shows that, when screwing on the closure cap 32, the predetermined breaking webs 27 were destroyed by the force of the pressure of the closure cap 32 and are therefore no longer to be seen. The segments 26 clamped in between the container shoulder 21 and the lower rim of the cap skirt 33 are consequently individually separated and are held only by this clamping.

To prevent during fitting, in this case screwing on, of the closure cap 32 and the accompanying tearing off of the predetermined breaking webs 27 a slipping away of the segments 26 under the rim of the cap skirt 33 before the latter rests in a clamping manner on the segments 26, the segments 26 are provided with detaining means, designed here as detaining noses 34. If, however, the clamping of the segments 26 is possible with adequate speed, or the pitch of the screwing thread is correspondingly steep, so that before achieving complete clamping the segments 26 cannot slip away under the lower rim of the cap skirt 33, or else the container shoulder 21 represented in FIG. 2 is level or oppositely inclined, it is possible to dispense with such detaining means. Since the closure cap 32 was consequently screwed onto the container 23 for the first time, generally after filling the container 32 with a free-flowing product, and at the same time the segments 26 of the indicator element 20 were individually separated, the segments 26 will fall out of the gap between the lower rim of the closure cap 32 and the container shoulder 21, and indicate by their absence the actuation of the closure cap or the opening of the container 23, if the closure cap has been moved in the opening direction.

In FIGS. 5 to 8 and the detail Y, a second embodiment of an originality-ensuring device with an annular indicator element 35 is shown. FIGS. 5 and 6 reveal that the indicator element 35 comprises a plurality of, in the present case four, segments 36, which are connected by four predetermined breaking webs 37. The connection of the arcuate segments 36 by the predetermined breaking webs 37 is in each case provided at a segment base 38. Connected in one piece to each segment base 38 is a separating device in the form of a separating lever 39. Each of the separating levers 39 has a flexible lever arm 40, the free end of which points in each case in the same circumferential direction and has a downwardly directed separating blade 41, which in the unloaded initial position is in each case arranged at a distance above a predetermined breaking web 37.

As can be seen from the representation of the segments 36 and of the lever arms 40 in a plan view in FIG. 6, the lever arms 40 are adapted in their form to the overall ring-segmentally designed segments 36. The upper side of each separating blade 41 is designed as a horizontal abutting surface 42, the function of which is explained in more detail below.

In FIGS. 7 and 8, parts of the container 23 coinciding with FIGS. 1 and 2 are provided with identical reference numerals. The indicator element 35 represented in FIG. 7 in an initial position, that is to say unloaded, is deformed, as represented in FIG. 8, by the pressure exerted by the lower rim of the cap skirt 33 in the direction of the arrow w. In this case, the lever arms 40 are swiveled in the direction of the predetermined breaking webs 37 in such a way that the predetermined breaking webs 37 are destroyed or severed by the separating blades 41. When the pressure is exerted on the lever arms 40 by the closure cap 32, the abutting surfaces 42 bear in surface contact against the lower rim of the cap skirt 33, so that the pressure exerted by the lower rim of the cap skirt 33 on the lever arms 40 is transferred essentially uniformly to the associated separating blade. Once severing of the predetermined breaking webs 37 has taken place, the four segments 36 individually separated as a result are held in a clamping manner between the lower rim of the cap skirt 33 and the container shoulder 21. When the container 23 is opened by unscrewing or removing the closure cap 32, the clamping is released and the individual segments 36 fall off the container 23. As a consequence, the act of use is clearly identifiable by the absence of the segments of the indicator element. On the other hand, after falling-off of the indicator element, the container has a pleasing appearance.

Figure 9:
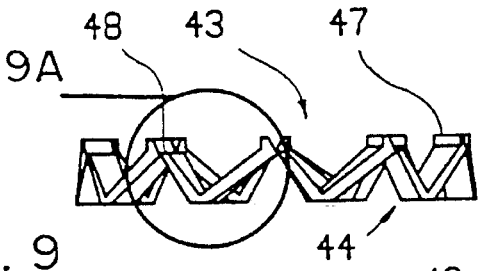
FIG. 9 shows a side view of a third embodiment of an originality-ensuring device in its undestroyed initial position, FIG. 9A being a detail noted in the circle 9A in FIG. 9, in enlarged representation.
Figure 9A:
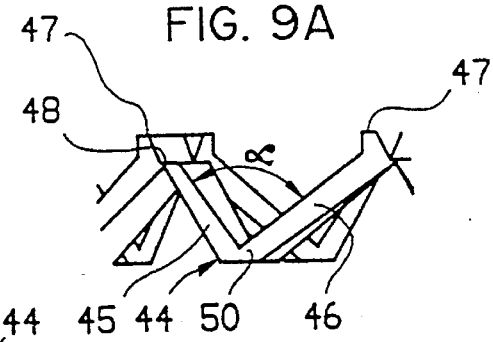

The third embodiment of an originality-ensuring device in FIGS. 9 to 12 comprises an indicator element 43. FIG. 9 and the detail X reveal that individual segments 44 have segment legs 45 and 46 arranged in a V-shaped manner. The vertex region 50, connecting the segment legs 45, 46, is designed to be strong enough that the resulting connection between the two segment legs 45, 46 cannot be impaired by forces of pressure exerted on the indicator element 43 and is only subjected to flexural stress. The angle $\alpha$ formed by the segment legs 45, 46 is asymmetric. FIG. 9 and its detail X reveal that in each case the right-hand segment leg 46 forms a more acute angle with respect to the resting plane of the annular indicator element 43, formed by the underside, than the associated segment leg 45.

Figure 10:
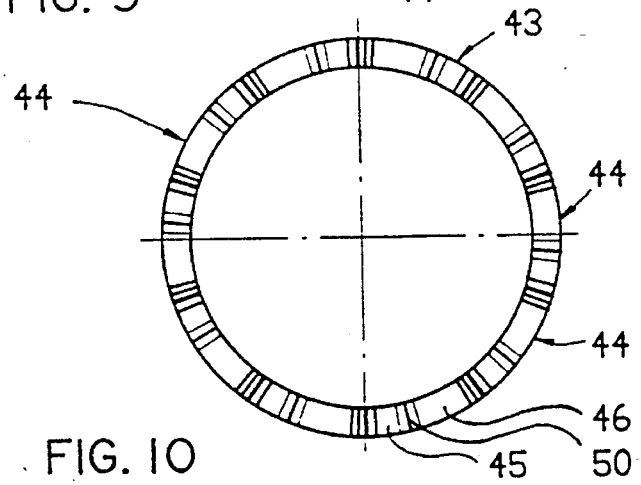
FIG. 10 shows the originality-ensuring device represented in FIG. 9 in plan view.

One of these two segment legs 45, 46, preferably the one which forms the more acute angle with the resting surface, namely in the present case the respectively right-hand segment leg 46 of a segment 44, is provided with an abutting nose 47, which in each case rises up beyond a predetermined breaking web 48, by which in each case a segment leg 46, provided with the abutting nose 47, is connected to a segment leg 45 of a neighboring segment 44. FIG. 10 shows that the individual segments 44 of the indicator element 43 are arranged with respect to one another in such a way that overall an annular form of the indicator element 43 is again produced.

Figure 11:
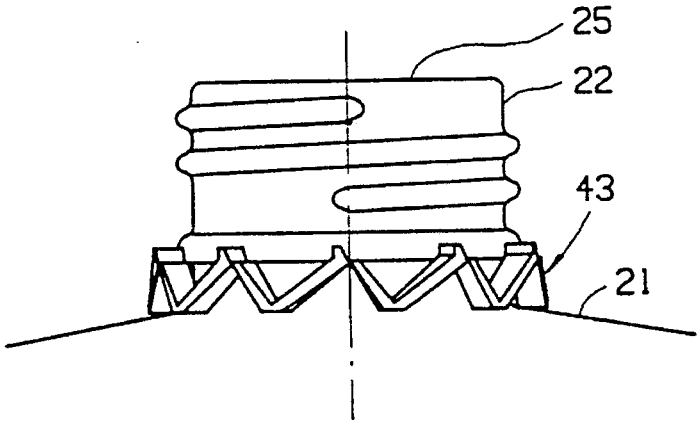
FIG. 11 shows a side view similar to FIGS. 1 and 7 of the annular originality-ensuring device according to FIGS. 9 and 10, in its initial position placed around a container neck on a container shoulder.
Figure 12:
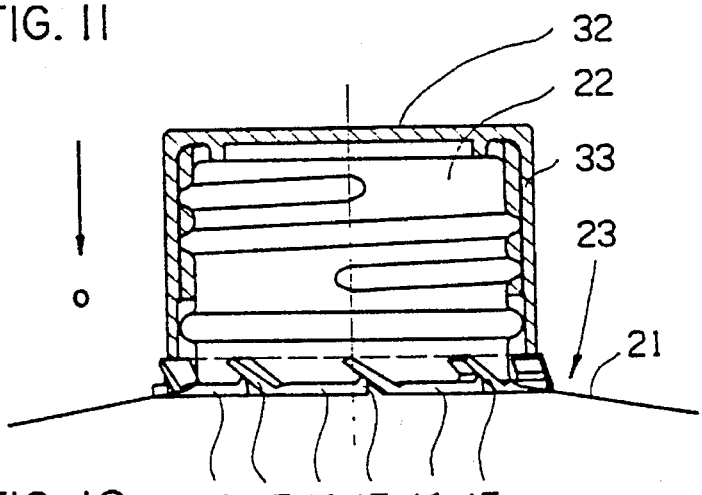
FIG. 12 shows a view similar to FIGS. 2 and 8 of the originality-ensuring device represented in FIG. 11 in a securement position clamped in between a container shoulder and a closure cap.

FIG. 11 shows the indicator element 43, arranged on the container shoulder 21 and surrounding the container neck 22, in an undeformed initial position. The destruction of the predetermined breaking webs 48 of the indicator element 43, which is achieved after closing the container opening 25 with the closure cap 32 for the first time and in which the individual segments 44 are arranged in an individually separated and clamped-in manner between the lower rim of the cap skirt 33 and the container shoulder 21, is represented in FIG. 12.

The operation of individually separating the segments 44 when exerting a force of pressure by screwing the closure cap 32 onto the container neck 22 in the direction of the arrow o is explained in more detail below. When screwing the closure cap 32 onto the container 23, the lower rim of the cap skirt 33 initially comes to bear against the upper end of the abutting noses 47 of the indicator element 43. Owing to the downwardly directed pressure then acting on the abutting noses 47, the predetermined breaking webs 48 between the respectively V-shaped segments 46 are destroyed. Immediately after this destruction of the predetermined breaking webs 48, the segment legs 46 push underneath the segment legs 45 on account of their more inclined angular position in comparison with said segment legs 45. If the pressure continues in the direction of the arrow o on the segments 44, the segment legs 46 continue to slide with their abutting noses 47 underneath the neighboring segment legs 45 of the adjacent segment 44, the latter supporting themselves in a lever-like manner on the abutting noses 47. As a result it is ensured that during the entire operation the segments 44 are wedged firmly against one another for as long as the closure cap 32 is not undone.

As a departure from the exemplary embodiments described, it is also possible to mold the upper side of the indicator elements integrally from plastic directly with the lower rim of the cap skirt, using predetermined breaking points as connecting elements, in such a way that the annular indicator element is screwed or pressed as a component part of the closure cap onto the container neck until it abuts on the container shoulder. On butting against the container shoulder, the predetermined breaking points between the closure cap and the indicator element are destroyed, just as are the predetermined breaking webs between the neighboring segments of the indicator element. As a consequence, in this case also, the individually separated segments between the closure cap and the container shoulder are firmly clamped in.

Furthermore, it can be appreciated that, instead of a container neck rising up from the container shoulder, use may also be made of a container in which the container neck protrudes into the interior of the container and is provided with an internal thread, which interacts with an external thread of a stopper-like container closure. In addition, the invention can also be used in the case of closures for containers or bottles which are pushed or pressed onto the container neck and lock into a closed position. Finally, the use of stopper-shaped closures which are inserted into the container opening until they abut on the opening rim or on a container shoulder is also conceivable.

The embodiments of the originality-ensuring device explained above can be realized particularly simply by indicator elements of preferably biodegradable plastic; however, the use of other materials, such as for example metal, is also conceivable.

We claim:

1. For use with a container having a neck which defines an opening of the container and which defines an axis and having a shoulder which projects from the neck in a generally radial direction relative to the axis and with a container closure which is capable of being applied to the neck of the container so as to close the opening of the container, an originality-ensuring device comprising an indicator element which is subdivided by predetermined breaking points into individual segments and which is adapted to be arranged around the neck of the container, between the shoulder of the container and the container closure, and which is arranged to be stressed therebetween by closing movement of the container closure, the indicator element being configured so that, when the indicator element is arranged around the neck of the container, between the shoulder of the container and the container closure, the predetermined breaking points remain unbroken until the indicator element is stressed therebetween by closing movement of the container closure, whereupon the predetermined breaking points are destroyed and the consequently individually separated segments are held in a firmly clamped-in manner between the container closure and the shoulder of the container.

2. The originality-ensuring device as claimed in claim 1, wherein the indicator element is of an annular design.

3. The originality-ensuring device as claimed in claim 1 or 2, wherein the indicator element is configured so that, when the indicator element is arranged between the shoulder of the container and the container closure, the segments of the indicator element are arranged on an imaginary conical surface and have end faces spaced circumferentially from one another, the end faces being connected to one another at a radially outer region of the indicator element by webs defining the predetermined breaking points until the indicator element is stressed by closing movement of the container closure.

4. The originality-ensuring device as claimed in claim 3, wherein the segments are provided at a radially inner region of the indicator element with means for detaining the segments between the shoulder of the container and the container closure while the container closure is being applied.

5. The originality-ensuring device as claimed in claim 1 or 2, wherein each of the segments of the indicator element are provided with a separating device which is formed in one piece with said element, and disposed such that said device can be actuated by closing movement of the container closure and is intended for severing said predetermined breaking point respectively connecting two segments.

6. The originality ensuring device as claimed in claim 5, wherein the separating device has a lever arm with a separating blade arranged at its free end.

7. The originality-ensuring device as claimed in claim 6, wherein the lever arm has at its free end, on the upper side lying opposite the separating blade, an abutting surface for the container closure.

8. The originality-ensuring device as claimed in claim 1 or 2, wherein the segments of the indicator element each comprise segment legs which are arranged in each case in a v-shaped manner in the circumferential direction of the indicator element, the upper ends of the segment legs respectively forming a V being connected in each case to the upper ends of segment legs of neighboring v-shaped segments by said predetermined breaking point.

9. The originality-ensuring device as claimed in claim 8, wherein one segment leg (46) of each segment (44) is formed with an abutting nose (47) which protrudes beyond the adjacent segment leg (45) of a neighboring segment in the region of the predetermined breaking point (48) and is disposed for bearing contact on the container closure (32) during the closing of the container (23).

10. The originality-ensuring device as claimed in claim 9, wherein the indicator element has an underside, which defines a resting plane of the indicator element, and wherein the first segment leg, provided with the abutting nose, is set at a more acute angle with respect to the resting plane of the indicator element than the other, second segment leg.

* * * * *